US006199326B1

(12) United States Patent
Mayle

(10) Patent No.: US 6,199,326 B1
(45) Date of Patent: Mar. 13, 2001

(54) ADJUSTABLE ROOF MEMBRANE

(76) Inventor: Robert L. Mayle, 2047 Hyde Rd., Port Clinton, OH (US) 43452

( * ) Notice: Subject to any disclaimer, the term of this patent is extended or adjusted under 35 U.S.C. 154(b) by 0 days.

(21) Appl. No.: 09/303,291

(22) Filed: Apr. 30, 1999

Related U.S. Application Data

(60) Provisional application No. 60/083,620, filed on Apr. 30, 1998.

(51) Int. Cl.[7] ..... E04B 1/36

(52) U.S. Cl. ..... 52/58; 52/60; 52/61; 52/287.1; 52/631

(58) Field of Search ..... 52/58, 60, 287.1, 52/631, 61

(56) References Cited

U.S. PATENT DOCUMENTS

| | | | | |
|---|---|---|---|---|
| 4,799,986 | | 1/1989 | Janni | 156/196 |
| 4,872,296 | * | 10/1989 | Janni | 52/58 |
| 5,605,019 | * | 2/1997 | Maziekien et al. | 52/58 |
| 5,706,610 | * | 1/1998 | Mayle | 52/60 |

* cited by examiner

*Primary Examiner*—Carl D. Friedman
*Assistant Examiner*—Patrick J. Chavez
(74) *Attorney, Agent, or Firm*—Standley & Gilcrest LLP

(57) ABSTRACT

The present invention is an adjustable corner fitment for a roof. The adjustable corner fitment is comprised of a top membrane and a bottom membrane. The top membrane has a cutout. The cutout extends from a side of the top membrane. The base membrane portion has a first side, a second side, a third side, and a fourth side. The first side is connected to the second side at a first angle greater than 90 degrees, and the third side is connected to the fourth side at a second angle greater than 90 degrees. The base membrane portion is conformed to loop shape such that the first side and the second side underlie portions of the top membrane contiguous to the cutout. The first side of the base membrane may be completely welded to the top membrane prior to installation. However, the second side of the base membrane is adjustable relative to the top membrane prior to installation on the roof. Consequently, an installer is enabled to adjust the corner fitment to a corner in the field to eliminate unnecessary buckling of the corner fitment or the roof membrane. After adjusting the corner fitment to the corner, the installer may then completely weld the second side of the base membrane to the top membrane.

20 Claims, 4 Drawing Sheets

FIG-8
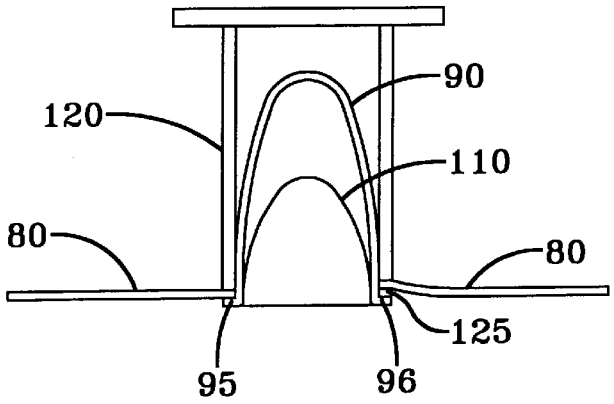
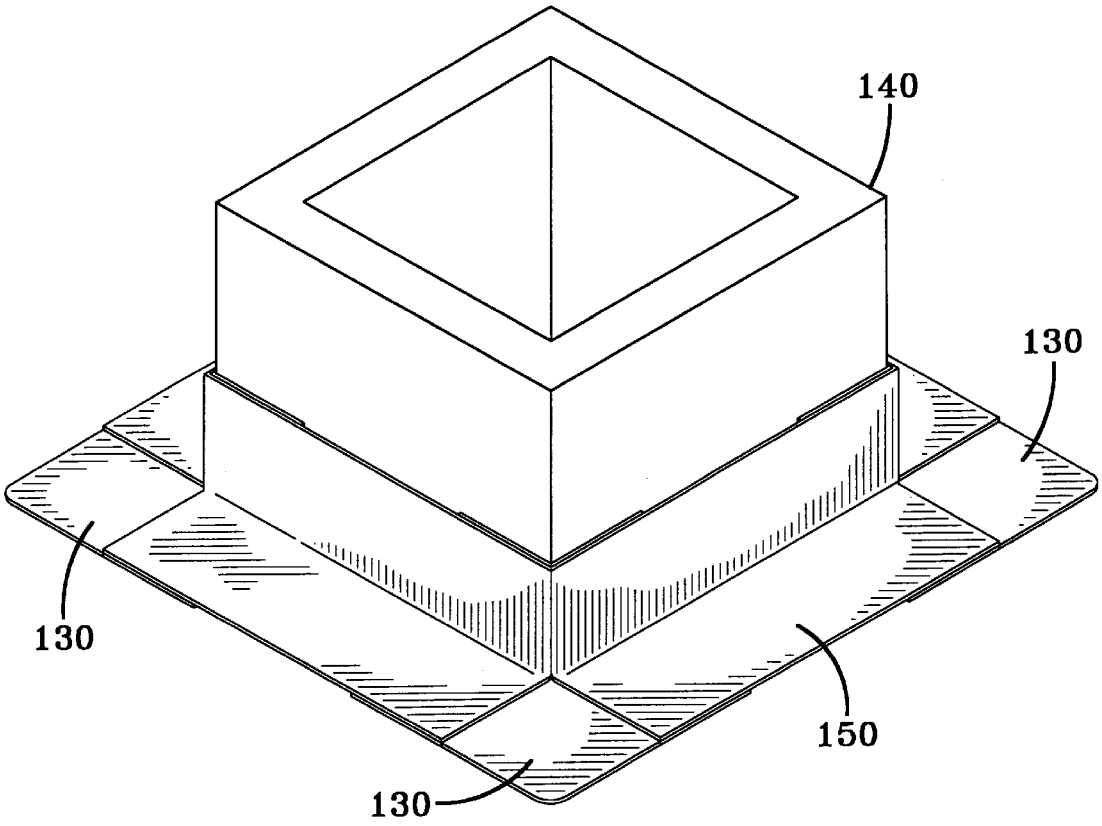
FIG-9

ADJUSTABLE ROOF MEMBRANE

This application claims the benefit of U.S. Provisional Application No. 60/083,620, filed Apr. 30, 1998.

BACKGROUND AND SUMMARY OF THE INVENTION

The present invention relates generally to roof-covering membranes, and more particularly, to an adjustable corner fitment and roof membrane system. Polymer-coated membranes may be used to cover substantially flat roofs. The membrane is preferably custom designed for the particular roof on which it is to be used. The roof measurements may be provided to a factory which may create a unitary membrane from separate pieces which have been heat welded together.

Items such as vents, ductwork, air conditioning units, and the like commonly protrude from the surface of a roof. The size and location of these items is preferably provided to the factory which creates the membrane. With this information, the factory may make provisions for these items in the membrane.

Providing a water-tight seal around a protrusion in a roof presents a number of problems. U.S. Pat. No. 4,799,086 and U.S. Pat. No. 4,872,296 disclose a method and a fitment which have been used to cover the corners of protrusions. The fitment of these patents comprises a first generally rectangular member segment, a side being part-way split interjacent its ends, and a second member segment with a triangularly-shaped corner portion conformed to loop shape and having its marginal edges overlying portions of the first segment contiguous to the split and being welded thereto in a continuous weld seam. This method and fitment work best when the angle of the corner is a right angle and the angle between the roof and the protrusion is a right angle.

In many cases, however, the corner is not a right angle, the protrusion is not at a right angle to the roof, or there is some other irregularity in the protrusion, such as the bottom and the top being different sizes. In these situations, known fitments and methods do not provide satisfactory results. The membrane must be folded or "bunched" in order to conform the membrane to the underlying structure. The folding and bunching is unsightly, and water may collect in the folds which may have deleterious effects on the roofing membrane and/or may lead to localized leaks at seams and at other places in the membrane. In addition, folding can lead to cracking of the roof membrane over time due in part to stress induced by the fold lines. Therefore, a need exists for an adjustable fitment and roof membrane system that provides a smooth transition no matter what the shape or angle of the underlying protrusion and that eliminates the need to fold or bunch the fitment or the roof membrane.

U.S. Pat. No. 5,706,610 provides one embodiment of an adjustable roof membrane which includes a universal fitment and a universal boot. The disclosure of U.S. Pat. No. 5,706,610 is hereby incorporated by reference. In this embodiment, the universal fitment has a body with preferably three sides, a tab, and a neck connecting a corner of the body to the tab. The body is preferably either substantially square or substantially triangular. The patent also discloses an embodiment of a universal boot. The universal boot has a generally rectangular section with a split extending vertically in a side, and it has a fitment with a body having at least three sides, a tab, and a neck connecting a corner of the body to the tab. The tab of the fitment is preferably welded to the back of the rectangular section above the split.

The present invention provides another embodiment of an adjustable fitment and roof membrane system and a method for making the adjustable fitment and roof membrane system. The fitment may be useful with roof membranes to cover exposed roof areas around a vertical protrusion in a roof. As used herein, a vertical protrusion includes all protrusions that have a vertical component. The fitment may be partially secured to a roof membrane, a boot, and/or a spanning strip prior to being positioned at the corner of a vertical protrusion. Alternatively, the fitment may be positioned independently of the other components at the corner of a vertical protrusion. After the fitment is positioned at the corner of a vertical protrusion, a floating portion of the fitment may be adjusted to fit the corner of the vertical protrusion so that there is minimal or no folding or bunching of the material of the fitment. In this adjusted position, the floating portion of the fitment may be heat welded or otherwise secured to another portion of the fitment, and the fitment may be finally heat welded or otherwise secured to the roof membrane, the boot, and/or the spanning strips.

In addition to the novel features and advantages mentioned above, other objects and advantages of the present invention will be readily apparent from the following descriptions of the drawings and preferred embodiments.

BRIEF DESCRIPTION OF THE DRAWINGS

FIG. 8 is an end cross sectional view of the fitment of FIG. 5 in position to be partially heat welded prior to installation; and FIG. 9 is a perspective view of another preferred embodiment of an adjustable roof membrane system of the present invention.

DETAILED DESCRIPTION OF PREFERRED EMBODIMENT(S)

Figure 1:
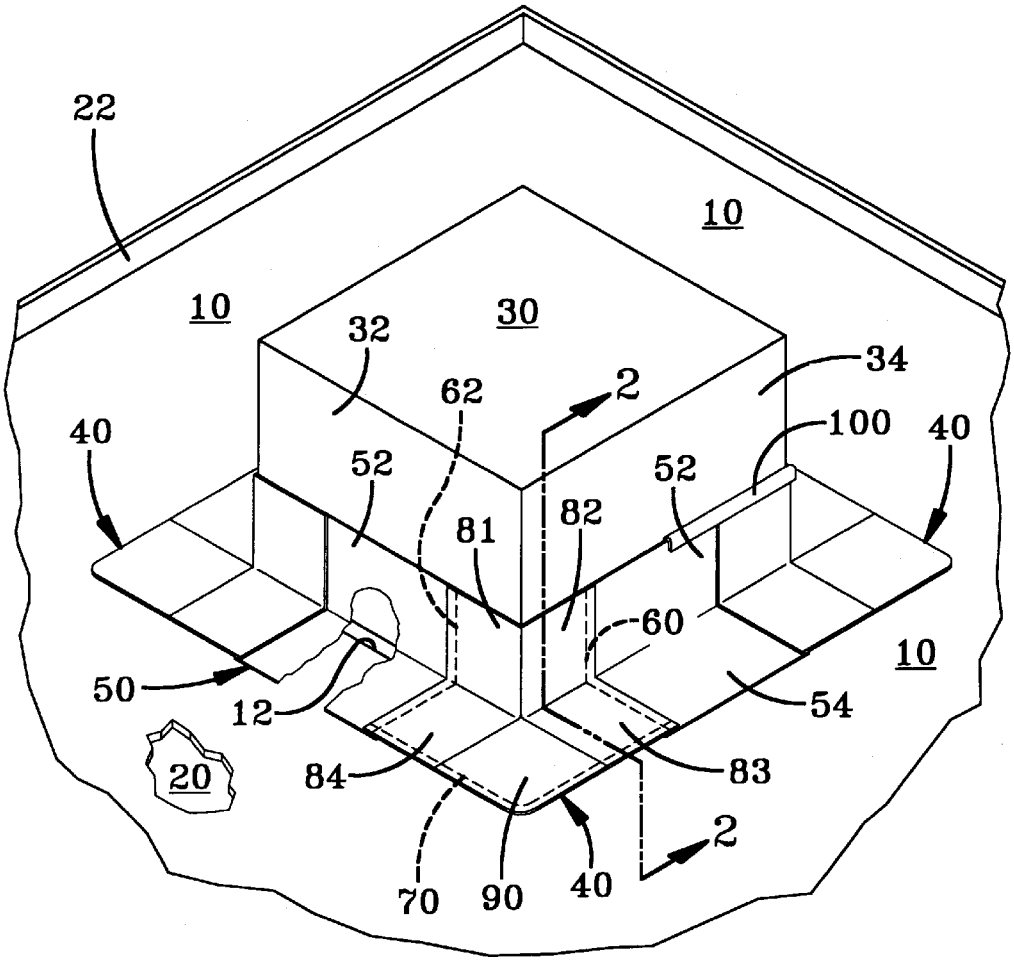
FIG. 1 is a perspective view of a preferred embodiment of an adjustable roof membrane system of the present invention.
Figure 2:
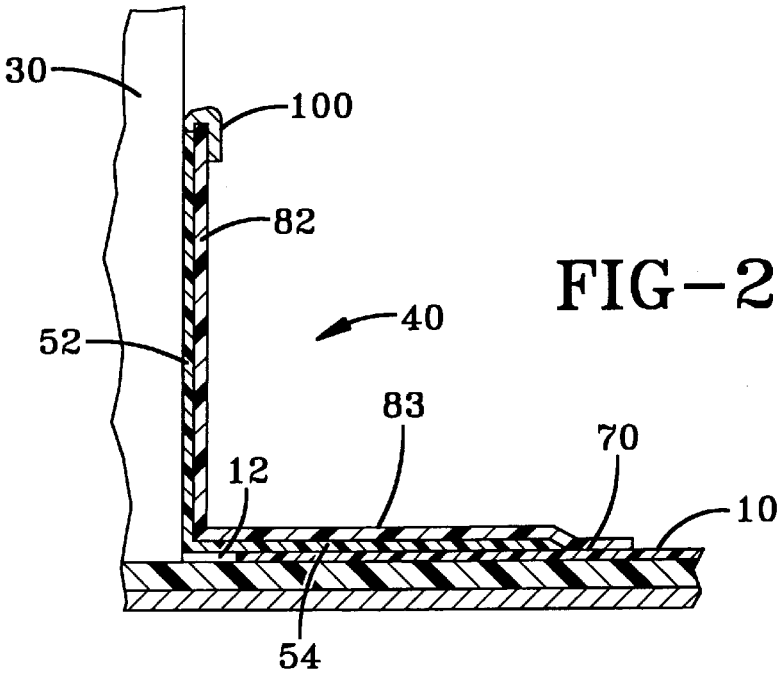
FIG. 2 is a cross sectional view taken on the line 2—2 of FIG. 1.

The present invention is directed to an adjustable fitment and roof membrane system and to a method for making the adjustable fitment and roof membrane system. Referring primarily to FIGS. 1 and 2, a polymer-membrane 10 is shown overlying a roof 20. The roof 20 may have a surrounding parapet 22. In addition, a protrusion 30 may extend from the roof 20. An opening 12 in the membrane 10 preferably allows the sides 32, 34 of the protrusion 30 to extend through the membrane 10. After the membrane 10 is in place on the roof 20, a preferred embodiment of a fitment 40 of the present invention may be installed to substantially prevent moisture from entering the roof 20 at a corner of the protrusion 30.

In one embodiment of an adjustable roof membrane system of the present invention, fitments 40 may be joined by spanning strips 50 as shown in FIG. 1. Each spanning strip preferably has an upper portion 52 and a bottom portion 54. The bottom portion 54 may be heat welded along its length to the membrane 10, and the fitments 40 may be heat welded to the membrane 10 and the spanning strips 50 as shown at 60, 62, and 70. Although not shown in the figures, it should also be recognized that the fitments 40 may positioned at the corners of a vertical protrusion such that they are overlapped by the spanning strips 50.

Figure 4A:
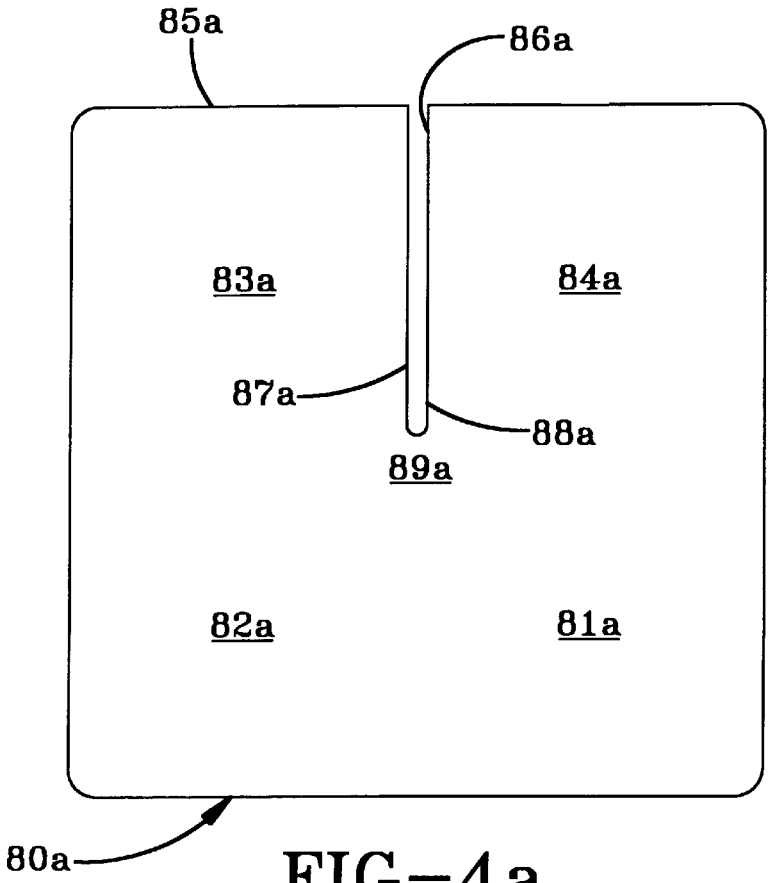
FIG. 4*a* is a top plan view of a preferred embodiment of a top membrane portion of a fitment of the present invention.

A fitment 40 preferably has a top membrane portion 80 and a base membrane portion 90. As illustrated in FIG. 4*a*, the top membrane portion 80*a* is preferably substantially rectangular, and it may be comprised of quadrants 81*a*, 82*a*, 83*a*, and 84*a*. The top membrane portion 80*a* has a cutout 86*a*. The cutout 86*a* preferably divides quadrant 83*a* from quadrant 84*a*, and it preferably extends from about the middle of side 85*a* to about the center portion 89*a* of the top membrane portion 80*a*. As shown in FIG. 4*a*, the cutout 86*a* may have substantially parallel sides 87*a*, 88*a*. For one example of the cutout 86*a*, the sides 87*a*, 88*a* may be separated by about one-half inch.

In addition to the embodiment shown in FIG. 4*a*, the top membrane portion 80 may take the form of many different shapes. The shape of the top membrane portion 80 may vary depending on the application. For example, the top membrane portion 80 may have a different number of sides, it may have curved sides, or it may have sides of different lengths. For another example, the cutout may extend from a portion of a side other than the middle, it may extend at an angle which is not perpendicular, or it may have a different shape, length, or width.

Figure 4B:
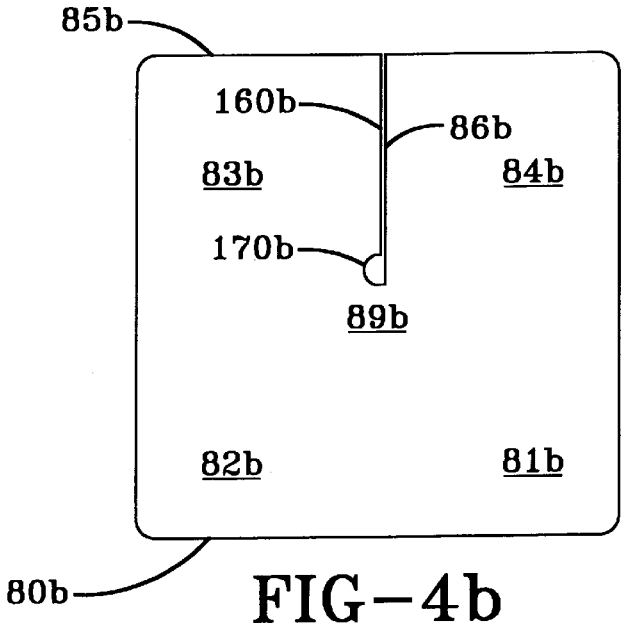
FIG. 4*b* is a top plan view of another preferred embodiment of a top membrane portion of a fitment of the present invention.

FIG. 4*b* shows another embodiment of the top membrane portion 80. In this embodiment, the cutout 86*b* includes a split 160*b* and an aperture 170*b*. The split 160*b* preferably extends from about the middle of the side 85*b* to about the center 89*b* of the top membrane portion 80*b*. The aperture 170*b* is preferably located at the end of the split 160*b* which is opposite the side 85*b*. The aperture 170*b* is adapted to enable the passage of a stud of a male die. As shown in FIG. 4*b*, the aperture 170*b* is preferably generally semi-circular.

Referring back to the embodiment of the adjustable roof membrane system shown in FIG. 1, quadrants 81, 82 of the top membrane portions 80 and upper portions 52 of the spanning strips 50 may be secured by an adhesive or other suitable means to the sides 32, 34 of the protrusion 30. A band 100 may be used to join the top edges of quadrants 81, 82 and upper portions 52. In addition, an adhesive, a bead of mastic, a bead of sealant, or any similar material may be used to form a tight seal between the band 100 and the sides 32, 34 of the protrusion 30.

Figure 3:
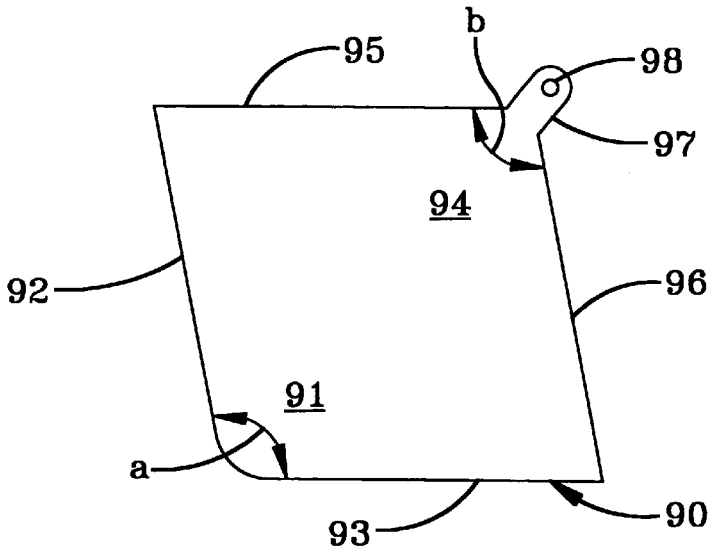
FIG. 3 is a top plan view of a preferred embodiment of a base membrane portion of a fitment of the present invention.

Referring to FIG. 3, the base membrane portion 90 is preferably comprised of a first generally triangular portion 91, a second generally triangular portion 94, and a tab 97 which has a hole 98. Sides 92, 93 of the first generally triangular portion 91 are preferably joined at a radiused corner. In addition, sides 92, 93 extend at an angle a which is greater than about 90 degrees. On the other hand, sides 95, 96 of the second generally triangular portion 94 are connected by the tab 97. The sides 95, 96 extend at an angle b which is greater than about 90 degrees. By making the angles a, b greater than about 90 degrees, the fitment 40 is preferably adjustable. In other words, the angles a, b preferably help to substantially eliminate the need to fold or bunch the fitment 40 when the corner is not a right angle, when the protrusion 30 is not at a right angle to the roof 20, or when there is some other irregularity in the protrusion 30.

A preferred method of making a fitment 40 begins by placing the base membrane portion 90 over a male die which preferably includes a generally triangular, pyramidal, or conical portion 110 and a stud. The portion 110 preferably has radiused edges. In addition, the portion 110 may be rounded. The base membrane portion 90 is preferably folded into a loop form around the portion 110 as generally shown in FIG. 8. In addition, the stud of the male die preferably extends through the hole 98 in the tab 97.

After the base membrane portion 90 is in place on the male die, the top membrane portion 80 may be placed over the male die as shown in FIG. 8. The stud preferably extends through the cutout of the top membrane portion 80. In addition, the portion 110 spreads the cutout and separates quadrants 83, 84.

As shown in FIG. 8, a female die 120 may then be placed over the portion 110. The top membrane portion 80 preferably overlaps edges 95, 96 of the base membrane portion 90. By overlapping edges 95, 96 with the top membrane portion 80, less water may collect in the joints between the top membrane portion 80 and the base membrane portion 90, and a more effective water-tight seal may be formed.

Figure 5:
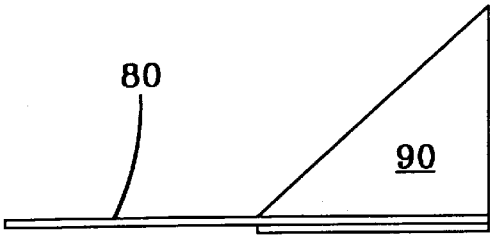
FIG. 5 is a side elevation view of a preferred embodiment of a fitment of the present invention prior to installation.
Figure 7:
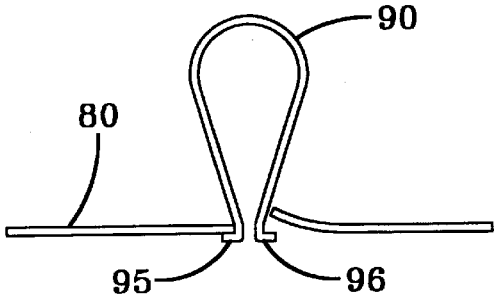
FIG. 7 is an end cross sectional view of the fitment of FIG. 5.
Figure 6:
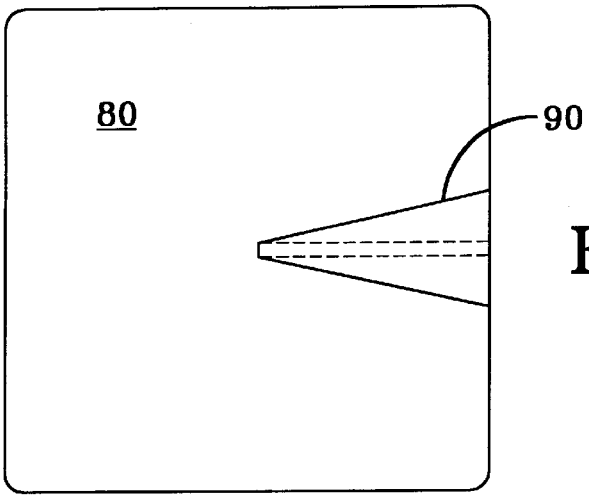
FIG. 6 is a top plan view of the fitment of FIG. 5.

An example of a fitment 40 prior to installation is shown in FIGS. 5 through 7. It is preferred that only one of the edges 95, 96 is completely heat welded to the top membrane portion 80 prior to installation on the roof. It is preferred that only a portion, if any at all, of the other edge 95, 96 is heat welded to the top membrane portion 80 prior to installation. This preferably enables the fitment 40 to be adjusted in the field to a corner that is not a right angle, a protrusion 30 that is not at a right angle to a roof 20, and/or an irregularly-shaped protrusion 30. After the fitment 40 is adjusted to the roof 20 and the protrusion 30 in the field to substantially eliminate any folding or bunching, the other edge 95, 96 may be heat welded along its entire length to the top membrane portion 80.

Those skilled in the art should also recognize that the top membrane portion 80 may be heat welded to the base membrane portion 90 prior to installation so that edges 95, 96 may both be adjusted in the field. For one example, the top membrane portion 80 may be heat welded only to the tab 97 of the base membrane portion 90 prior to installation. For another example, the top membrane portion 80 may be heat welded only to the tab 97 and a limited portion of one or each side 95, 96 of the base membrane portion 90 prior to installation.

A dielectric welding press may be used to make the necessary heat welds prior to installation. In particular, the male die is preferably fixed to an electrically energized bottom plate which comprises the platform of a dielectric welding press. However, the portion 110 of the male die is preferably comprised of a material such as plastic which is not a conductor of microwave energy. The female die 120, on the other hand, may be engaged by a top plate of the dielectric welding plate. An interference member 125 may be used to prevent undesired heat welding of a predetermined portion of one or each of the edges 95, 96 to the top membrane portion 80. The interference member 125 may be comprised of plastic or any other suitable material.

FIG. 9 shows another example of an adjustable roof membrane system of the present invention. The fitments 130 are preferably similar to the fitment 40. The fitments 130 may be used in conjunction with a universal boot such as the one disclosed in U.S. Pat. No. 5,706,610. The fitments 130 may be adjusted and secured to the corners of the protrusion 140. A boot 150 may be placed around the protrusion 140 and over the fitments 130. The boot 150 may then be heat welded to the fitments 130. For another example, a boot 150 may first be placed around and secured to the protrusion 140. The fitments 130 may be placed around the corners of the protrusion 140 such that they overlap the boot 150. The fitments 130 may then be adjusted and heat welded to the boot 150.

The preferred embodiments herein disclosed are not intended to be exhaustive or to unnecessarily limit the scope of the invention. The preferred embodiments were chosen and described in order to explain the principles of the present invention so that others skilled in the art may practice the invention. Having shown and described preferred embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. An adjustable corner fitment comprising:

a top membrane having a cutout, said cutout extending from a side of said top membrane; and a base membrane portion having a first side, a second side, a third side, and a fourth side, said first side extending from said second side at a first angle greater than 90 degrees, said third side extending from said fourth side at a second angle greater than 90 degrees, said base membrane portion conformed to loop shape such that said first side and said second side underlie portions of said top membrane contiguous to said cutout;

wherein said first side of said base membrane is welded to said top membrane prior to installation; and wherein said second side of said base membrane is adjustable relative to said top membrane prior to installation;

whereby an installer is enabled to adjust said corner fitment to a corner in the field and then complete said weld by welding in a second weld step said second side of said base membrane to said top membrane.

2. The fitment of claim 1 wherein said top membrane is generally rectangular.

3. The fitment of claim 1 wherein said base membrane is generally diamond-shaped.

4. The fitment of claim 1 wherein said cutout has two substantially parallel sides.

5. The fitment of claim 4 wherein said parallel sides of said cutout are separated by about 0.5 inch.

6. The fitment of claim 1 wherein said cutout is comprised of a split and an aperture, said split extending from said side of said top membrane, said aperture located at the end of said split which is opposite said side of said top membrane.

7. The fitment of claim 6 wherein said aperture is generally semi-circular.

8. The fitment of claim 1 wherein said cutout extends from a middle portion of said side of said top membrane.

9. The fitment of claim 1 wherein said first side and said second side of said base membrane are connected by a tab.

10. The fitment of claim 1 wherein said second side of said base membrane is partially welded to said top membrane prior to installation.

11. An adjustable corner fitment comprising:

a top membrane having a cutout, said cutout extending from a side of said top membrane; and a base membrane portion having a first side, a second side, a third side, a fourth side, and a tab, said first side extending from said second side by said tab at a first angle greater than 90 degrees, said third side extending from said fourth side at a second angle greater than 90 degrees, said base membrane portion conformed to loop shape such that said first side, said second side, and said tab underlie portions of said top membrane contiguous to said cutout;

wherein said tab of said base membrane is welded to said top membrane prior to installation; and wherein said first side and said second side of said base membrane are adjustable relative to said top membrane prior to installation;

whereby an installer is enabled to adjust said corner fitment to a corner in the field and then complete said weld by welding in a second weld step said first side and said second side of said base membrane to said top membrane.

12. The fitment of claim 11 wherein said top membrane is generally rectangular.

13. The fitment of claim 11 wherein said base membrane is generally diamond-shaped.

14. The fitment of claim 11 wherein said cutout has two substantially parallel sides.

15. The fitment of claim 14 wherein said parallel sides of said cutout are separated by about 0.5 inch.

16. The fitment of claim 11 wherein said cutout is comprised of a split and an aperture, said split extending from said side of said top membrane, said aperture located at the end of said split which is opposite said side of said top membrane.

17. The fitment of claim 16 wherein said aperture is generally semi-circular.

18. The fitment of claim 11 wherein said cutout extends from a middle portion of said side of said top membrane.

19. The fitment of claim 11 wherein said first side or said second side of said base membrane is partially welded to said top membrane prior to installation.

20. The fitment of claim 11 wherein said first side and said second side of said base membrane are partially welded to said top membrane prior to installation.

* * * * *